US005876255A

United States Patent [19]

Oda et al.

[11] Patent Number: 5,876,255

[45] Date of Patent: Mar. 2, 1999

[54] ELECTRICAL DISTRIBUTION BOX

[75] Inventors: Akihiro Oda; Hirokazu Ito, both of Yokkaichi, Japan

[73] Assignee: Sumitomo Wiring Systems, Ltd., Yokkaichi, Japan

[21] Appl. No.: 920,560

[22] Filed: Aug. 28, 1997

[30] Foreign Application Priority Data

Sep. 11, 1996 [JP] Japan ..... 8-240242

[51] Int. Cl.[6] ..... H01R 13/514

[52] U.S. Cl. ..... 439/752; 439/701

[58] Field of Search ..... 439/595, 701, 439/598, 752

[56] References Cited

U.S. PATENT DOCUMENTS 5,015,200 5/1991 Abernethy ..... 439/595
5,190,476 3/1993 Chailott ..... 439/595
5,257,951 11/1993 Maeda ..... 439/752
5,403,212 4/1995 Aimasso ..... 439/752
5,620,346 4/1997 Okumura ..... 439/752

FOREIGN PATENT DOCUMENTS 6-46519 2/1994 Japan .

*Primary Examiner*—Gary Paumen
*Assistant Examiner*—Briggitte R. Hammond
*Attorney, Agent, or Firm*—Oliff & Berridge, PLC

[57] ABSTRACT

An electrical distribution box for a vehicle has a body defining an accommodation space, and a casing inserted into and located in the accommodation space. A plurality of first electrical terminals are mounted in the casing, having been carried into the body by the casing. Holding members on the body and the casing cooperate to hold the casing in the accommodation space, and locking members on the casing act to lock the terminals in position in the casing at least when the casing is inserted into and located in the accommodation space. Thus the terminals can be easily inserted to the correct positions, without risk of damage.

12 Claims, 5 Drawing Sheets

ELECTRICAL DISTRIBUTION BOX

BACKGROUND OF THE INVENTION

1. Field of Invention

The present invention relates to an electrical distribution box which is used as a fuse box or the like, especially an electrical distribution box for use in a vehicle, e.g., an automobile.

2. Description of Related Art

Generally, an electrical distribution box for a vehicle is used as a fuse box, a relay box, a junction box, or the like, typically having fuses which are used as circuit protection members mounted in the distribution box. The box includes electrical circuit members connected to the fuses via terminals which receive the fuses.

An electrical distribution box is disclosed in JP-A-6-46519 and U.S. Pat. No. 5,257,951. The electrical distribution box was devised to make it easy to mount terminals to be connected to fuses and prevent the removal of the terminals from the electrical distribution box. The double locking member of the electrical distribution box disclosed in these documents is used to check whether each terminal has been mounted at a predetermined position and to prevent the removal of the terminals. The double locking member is laterally inserted into the slight gap between the terminals and the casing in which the terminals have been mounted. The penetration of the double locking member into the slight gap allows an operator to confirm that each terminal has been mounted at the predetermined position. Further, when the double locking member has penetrated a predetermined distance into the slight gap, the double locking member is engaged by the terminals, thus preventing them from being removed from the electrical distribution box. But in this construction, there is a possibility that the operator forgets to insert the double locking member into the slight gap. Further, it is troublesome to insert the double locking member into the slight gap, and in addition, the double locking member is required to have a high size accuracy. That is, the double locking member is required to have a high degree of strength as well as a high degree of size accuracy so that it is not deformed, which leads to a high manufacturing cost.

SUMMARY OF THE INVENTION

The present invention has been made to solve the above-described problems. Accordingly, it is an object of the present invention to provide an electrical distribution box which allows terminals to be mounted therein at the correct location, with ease and at a low cost.

According to one aspect of the invention there is provided an electrical distribution box having a body defining an accommodation space, and a casing inserted into and located in the accommodation space and having a plurality of terminal-mounting portions. A plurality of first electrical terminals are mounted in the casing at the terminal-mounting portions and are carried into the accommodation space when mounted in the casing. Holding members, respectively, on the body and the casing cooperate so as to hold the casing in the accommodation space. Locking members on the casing act to lock the electrical terminals in position in the casing at least when the casing is inserted into and located in the accommodation space.

In this construction, the casing accommodating the terminals is held in the box body by merely inserting the casing into the accommodation space. In the state in which the casing is accommodated in the body, the terminals are locked to the box body by the locking members. The invention thus provides a novel assembly method for an electrical connection box having terminals.

Preferably the locking members and the first electrical terminals are arranged to cooperate so that, when the terminals are incorrectly located in the casing in such a manner that the locking members do not lock the terminals in position, the locking members project from the casing so as to prevent insertion of the casing into the accommodation space.

Preferably the locking members are constituted by resiliently flexible portions of a side wall of the casing having free ends and having locking projections at their respective free ends, the locking projections engaging the terminals. The terminals accommodated inside the casing are thus locked to the body by inserting the casing into the accommodation space. Therefore, unlike the conventional distribution box described previously, special parts such as the double locking member are not required.

Preferably the holding members are constituted by respective projections on mutually facing side walls of the body and the casing. Thus the casing can be reliably held in the body by the holding members by merely inserting the casing into the accommodation space.

The invention also relates to mounting the electrical connection box in a vehicle.

BRIEF DESCRIPTION OF THE DRAWINGS

These and other objects and features of the present invention will become clear from the following description taken in conjunction with preferred embodiments thereof described below with reference to the accompanying drawings throughout which like parts are designated by like reference numerals, and in which.

DETAILED DESCRIPTION OF PREFERRED EMBODIMENTS

Figure 1:
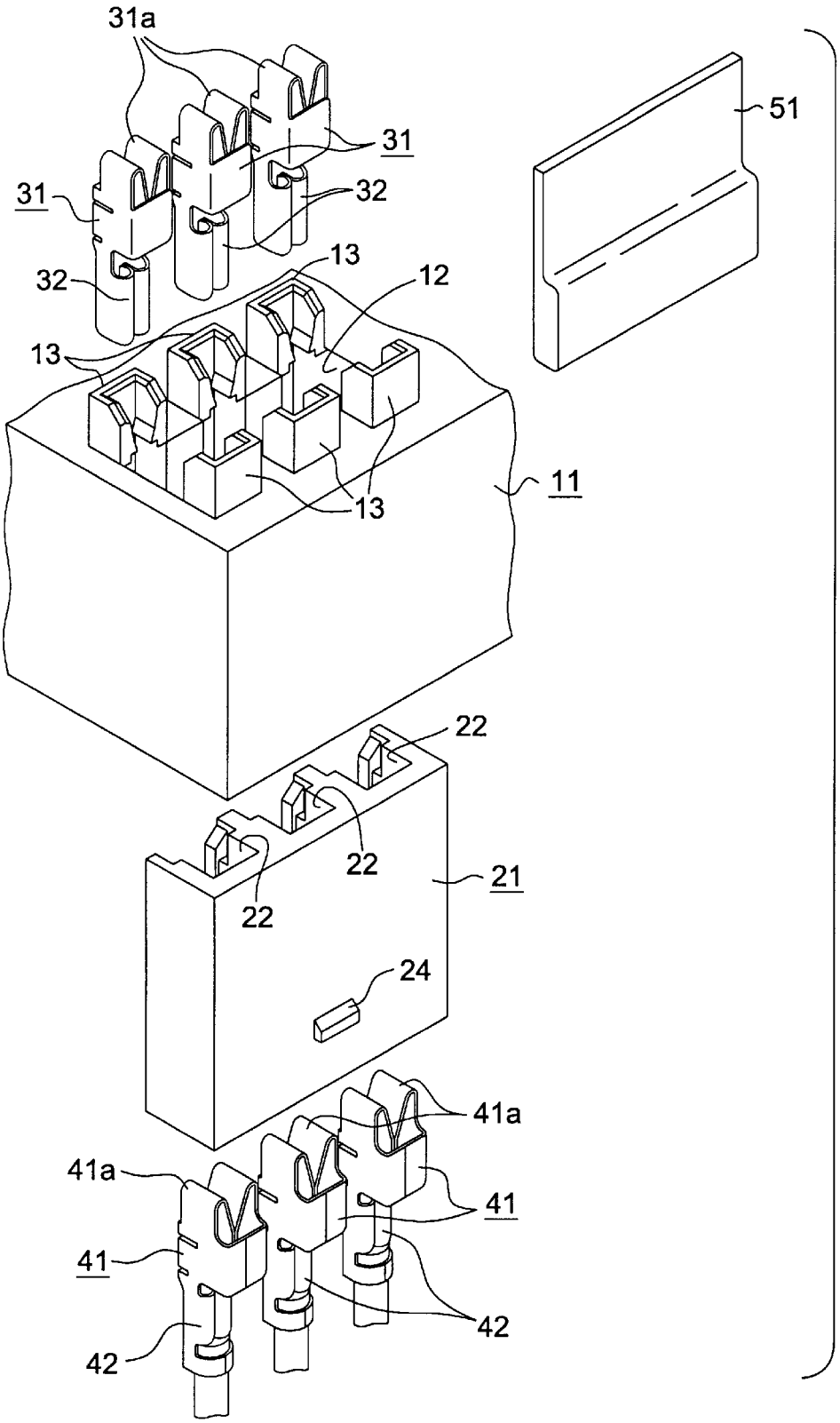
FIG. 1 is an exploded perspective view showing an electrical distribution box for an automobile, embodying the invention.
Figure 2B:
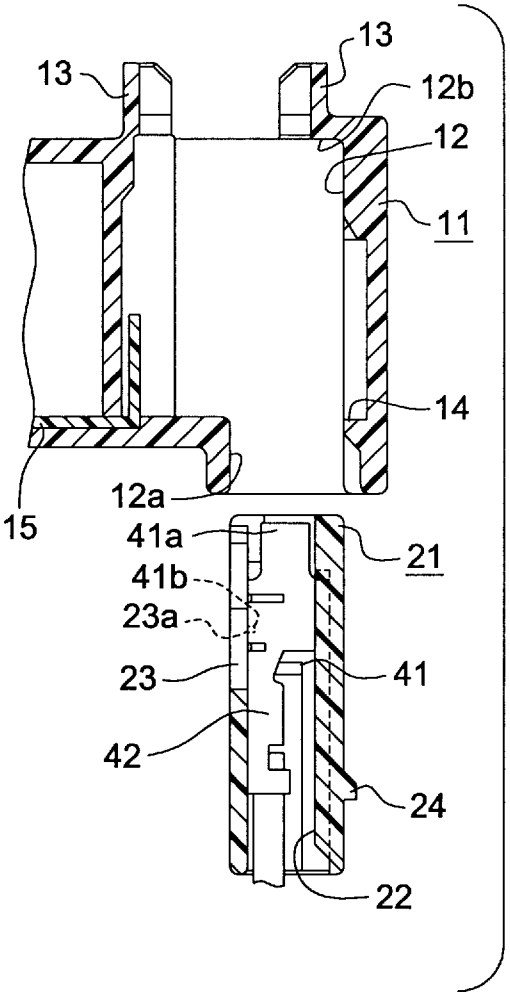
FIGS. 2(*a*)–2(*d*) are partial sectional views showing the assembling method of the electrical distribution box of FIG. 1.
Figure 2A:
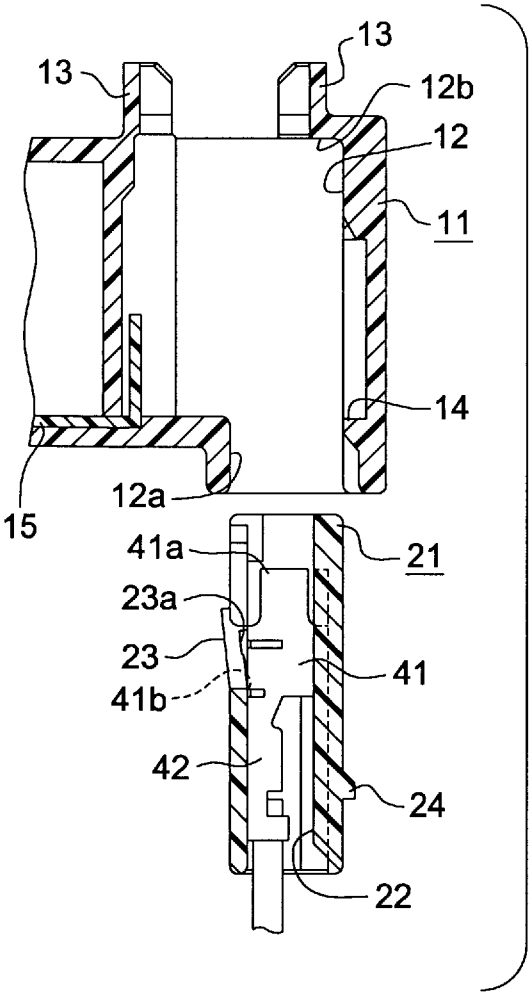
Figure 2D:
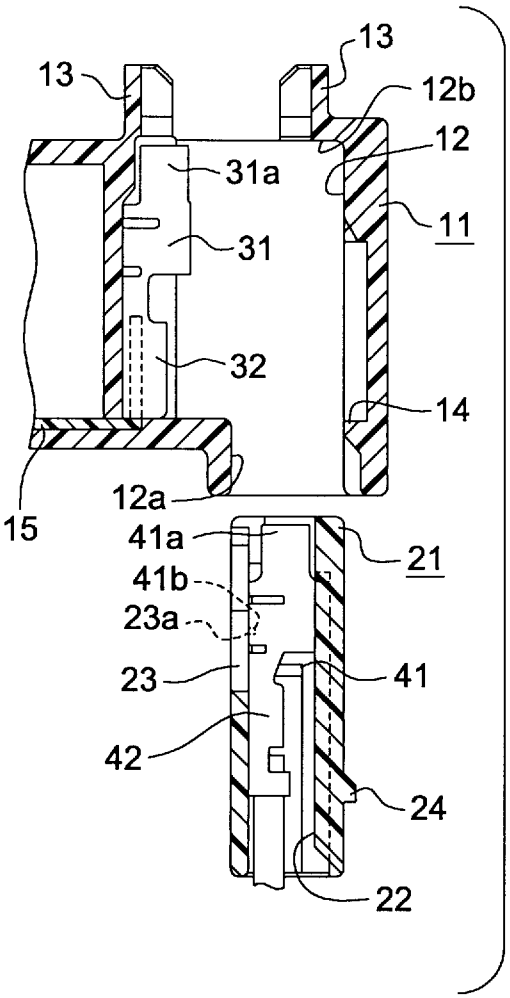
Figure 2C:
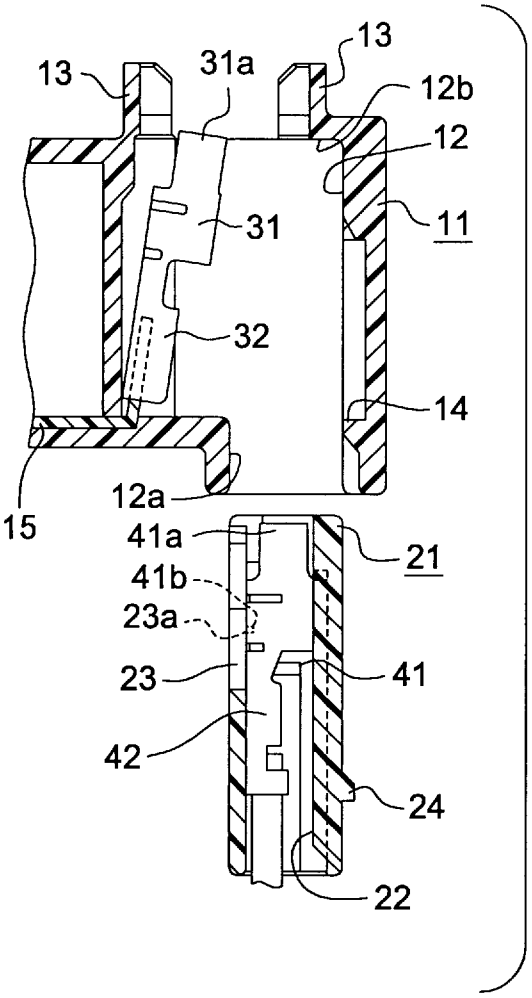

The electrical distribution box embodying the present invention shown in FIG. 1 has a box body 11 formed in one-piece of, e.g., synthetic resin material. An accommodation space 12 is formed in a part of the body 11. In the accommodation space 12 is an array of first terminals 41, and second terminals 31 arranged in pairs. In use, each pair receives a removable fuse (not shown) of conventional type. A plurality of pairs of fuse guides 13 project from the upper surface of the body 11. The fuse guides 13 are formed in one-piece with the body 11. Further, as shown in FIGS. 2(*a*)–(*d*) and 3(*a*)–(*c*), an insertion mouth 12*a*, also in one-piece with the body 11, projects at a lower part of the box body 11. A projection 14 constituting a first holding member is formed on an inner side surface of the body 11 at a lower portion thereof. A slope is provided on the lower surface of the projection 14. A stop surface 12*b* is formed inside the body 11 below each of the pairs of the fuse guides 13. A wiring substrate 15 composed of a conductor is positioned on the inner side of the bottom surface of the box body 11. A part of the wiring substrate 15 projects into the accommodation space 12.

The body 11 is shown only partially in FIG. 1 since it may have other portions, containing other electrical components, which are not relevant to the present inventive concept.

As shown in FIGS. 1 to 4, a casing 21 formed in one-piece of synthetic resin, similarly to the body 11, has a plurality of terminal insertion holes 22 arranged in a row, serving as terminal installing portions. A plurality of resiliently flexible locking strips 23 serving as locking members are integrally formed on one side surface of the casing 21 in correspondence to the terminal insertion holes 22. A locking projection 23*a* is formed on the inner vertical surface of each locking strip 23 at an upper free end thereof. A projection 24 having a slope formed on its upper surface is formed on the other side surface of the casing 21.

Each of a plurality of electrical second terminals 31 is composed of a fuse insertion portion 31*a* formed on the upper part thereof and a substrate sandwiching portion 32 formed on the lower part thereof.

Similarly to the second terminal 31, each of a plurality of first terminals 41 is composed of a fuse insertion portion 41*a* similar to that of the second terminals 31 and an electric wire crimping portion 42. A recess 41*b* is formed on one side surface of the fuse insertion portion 41*a*.

A partitioning plate 51 formed of synthetic resin material can be inserted into the accommodation space 12. The thickness of the upper part of the partitioning plate 51 is smaller than that of the lower part thereof.

The electrical distribution box is assembled from the component parts described above follows:

Initially, as shown in FIG. 2(*a*), the first terminals 41 are moved upward into the respective terminal insertion holes 22 of the casing 21. As a result, each locking strip 23 is flexed outward due to the engagement between one side surface of each first terminal 41 and the locking projection 23*a*, thus allowing each first terminal 41 to be fully inserted into the corresponding terminal insertion hole 22.

Then, as shown in FIG. 2(*b*), when each first terminal 41 has been moved upward to a predetermined position inside the terminal insertion hole 22, each locking projection 23*a* engages the recess 41*b* of each first terminal 41. As a result, each locking strip 23 returns to the original position, thus locking the first terminal 41 in fixed position in the casing. Thus, the first terminal 41 is held in each terminal insertion hole 22 and cannot be removed.

As shown in FIG. 2(*c*), each of the second terminals 31 is inserted obliquely downwards into the accommodation space 12 to connect the substrate sandwiching portion 32 of each second 31 with the wiring substrate 15, a part of which projects into the accommodation space 12. Then, as shown in FIG. 2(*d*), each second terminal 31 is held erect on the bottom surface of the body 11 at a predetermined position thereof by the elastic force of the wiring substrate 15.

Figure 3A:
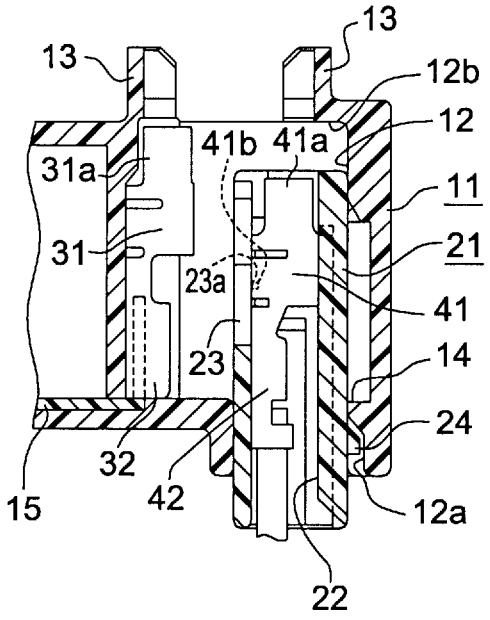
FIGS. 3(*a*)–3(*c*) are further partial sectional views showing the assembling method of the electrical distribution box of FIG. 1.
Figure 3B:
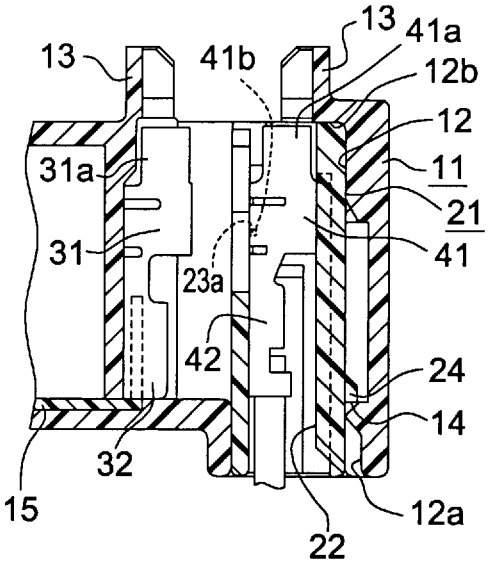
Figure 3C:
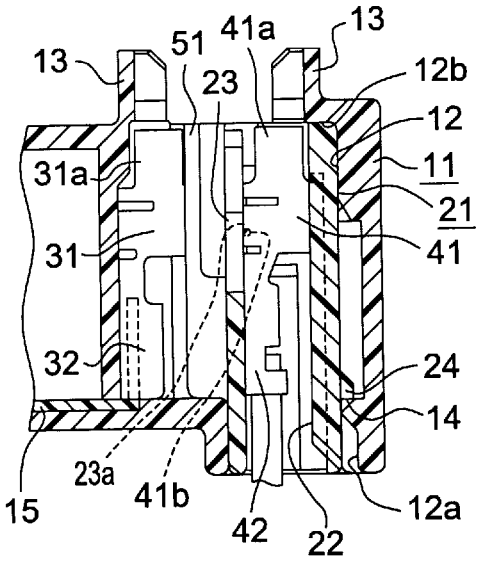
Figure 4:
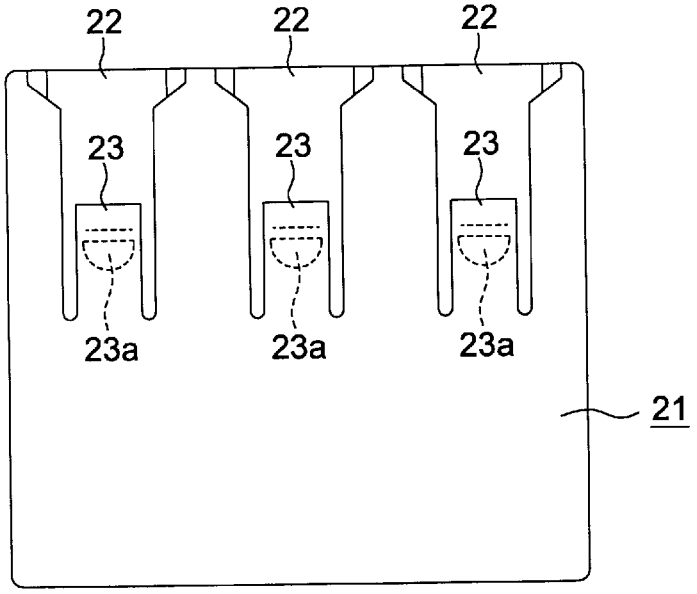
FIG. 4 is a front view showing a casing of the electrical distribution box of FIG. 1.

Then, as shown in FIG. 3(*a*), the casing 21 in which the first terminals 41 have been mounted is moved upward into the accommodation space 12 through the insertion mouth 12*a* formed at the lower portion thereof. If any of the first terminals 41 have not been inserted into the respective terminal insertion holes 22 correctly, the corresponding locking strip 23 remains flexed outward. This is because the locking portion 23*a* of the locking projection 23 is not correctly fitted into the recess 41*b* of the corresponding first terminal 41. Accordingly, in this state, the casing 21 cannot be inserted into the accommodation space 12.

Then, as shown in FIG. 3(*b*), the slope of the projection 24 of the casing 21 engages the slope of the projection 14 formed on the inner vertical surface of the body 11. Owing to the interaction of these two slopes, the projection 24 moves upward past the projection 14. When the lower surface of the projection 24 has engaged the upper surface of the projection 14, with the upper surface of the casing 21 in contact with the stop surface 12*b*, the casing 21 is located and held in the accommodation space 12.

Finally, as shown in FIG. 3(*c*), the partitioning plate 51 is inserted into the gap between the second terminals 31 and the casing 21. Consequently, the second terminals 31 and the casing 21 accommodated in the accommodation space 12 are fixed non-removably to the box body 11.

Then, a fuse (not shown) is connected with the fuse insertion portions 31*a* and 41*a* of each respective pair of the first and second terminals 41 and 31, respectfully.

Effects that can be provided by the distribution box according to the embodiment are described below.

(a) Because the first terminals 41 are installed in the casing 21 prior to mounting them in the box body 11, the first terminals 41 can be prevented from being bent or deformed.

(b) If the first terminals 41 are not correctly accommodated in the terminal insertion holes 22, when the casing 21 is inserted into the accommodation space 12, the locking strips 23 project outward. Thus, the casing 21 cannot be inserted into the accommodation space 12. Accordingly, the first terminals 41 can be prevented from being incorrectly located in the accommodation space 12.

(c) The casing 21 is accommodated in the accommodation space 12 and held by the holding members comprising the projections 14 and 24 by merely inserting the second terminals 31 and the casing 21 accommodating the first terminals 41 into the accommodation space 12. Therefore, the casing 21 can be easily installed in the body 11 without requiring special parts for holding the casing 21 on the body 11.

(d) The casing 21 can be prevented from removal from the accommodation space 12 by the engagement between the projection 14 formed on the body 11 and the projection 24 formed on the casing 21. Therefore, unlike the above-described construction of the known distribution box, it is possible to eliminate the need for the provision of special component parts such as a double locking member having a high degree of accuracy and strength.

(e) When the first terminals 41 are inserted into the casing 21 at the predetermined position thereof, each of the flexible locking strips 23 engages the recess 41*b* of each of the first terminals 41, thus clicking into position. Accordingly, the audible click of the engagement between the flexible locking strip 23 and the recess 41*b* makes it possible for an operator to confirm that the first terminal 41 has been correctly mounted in the casing 21. When the casing 21 has been inserted into the predetermined position of the accommodation space 12, the projections 14 and 24 engage each other, thus also clicking. This audible click allows the operator to confirm that the casing 21 has been correctly mounted on the body 11. In this manner, it is possible to confirm the completion of the mounting of the first terminals 41 in the box body 11.

The above-described embodiment may be modified as described below. The modified electrical distribution box provides operation and effects similar to those of this embodiment. For example, the partitioning plate 51 may be formed integrally with the box body 11. This allows the number of parts to be reduced, but necessitates the upper open part of the accommodation space 12 to be widened so that the second terminals 31 can be smoothly inserted into the accommodation space 12.

The electrical distribution box of the illustrated embodiment according to the present invention provides the following advantages:

Because the first terminals 41 are installed in the casing before mounting them in the box body, they can be prevented from being bent or deformed. This eliminates the need for the provision of special parts having a high degree of accuracy and strength in mounting the first terminals on the body. Further, the terminals can be installed on the body easily. Therefore, the electrical distribution box can be manufactured at a low cost.

The arrangement also eliminates the need for the provision of special parts for locking the second terminals to the box body, thus having a simple construction.

The electrical distribution box accommodates and holds the casing which is inserted into the accommodation space, thus eliminating the need for the provision of special parts for locking the second terminals to the box body and allowing the terminals to be mounted on the box body easily.

Although the illustrated embodiment is a fuse box, the invention may also be applied to other distribution boxes containing electrical terminals, for example connection boxes and relay boxes.

Although the present invention has been fully described in connection with preferred embodiments thereof with reference to the accompanying drawings, it is to be noted that various changes and modifications are apparent to those skilled in the art. Such changes and modifications are to be understood as included within the scope of the present invention.

What is claimed is:

1. An electrical distribution box comprising:

a body defining an accommodation space;

a casing inserted into and located in said accommodation space and having a plurality of terminal-mounting portions located between opposed side walls of the casing;

a plurality of first electrical terminals mounted in said casing at said terminal-mounting portions, wherein said first electrical terminals are mounted in said casing before being carried into said accommodation space;

holding members on said body and said casing, said holding members cooperating so as to hold said casing in said accommodation space; and locking members on said casing acting to lock said first electrical terminals in position in said casing, said locking members and said holding member of said casing, respectively, being formed on the opposed side walls of the casing, wherein said locking members and said first electrical terminals are arranged to cooperate so that, when said first electrical terminals are incorrectly located in said casing in such a manner that said locking members do not lock said first electrical terminals in position, said locking members project from said casing so as to prevent insertion of said casing into said accommodation space, and, when the first electrical terminals are correctly located in the casing, the locking members can lock the first electrical terminals in the casing and the casing can be inserted into the accommodation space.

2. An electrical distribution box according to claim 1, wherein said locking members comprise resiliently flexible portions of one of said opposed side walls, said locking members having free ends including locking projections, said locking projections engaging said first electrical terminals to lock said first electrical terminals in said casing.

3. An electrical distribution box according to claim 1, wherein said body has a side wall that faces one of the opposed side walls of the casing, said holding members being constituted by respective projections on said side wall of said body and said one of the opposed side walls of said casing.

4. An electrical distribution box according to claim 1, further comprising a partitioning member that prevents the locking members on the casing from opening when the casing is inserted into the accommodation space of the body.

5. An electrical distribution box according to claim 1 further comprising a plurality of second electrical terminals mounted in said accommodation space outside said casing.

6. An electrical distribution box according to claim 5, further comprising a partitioning member inserted along axes of the first and second terminals into said body and acting to hold said second electrical terminals and said casing in position within the body.

7. An electrical distribution box comprising:

a body defining an accommodation space, said accommodation space defining a first open end and a second open end opposite said first open end;

a casing inserted into the first open end and located in said accommodation space and having a plurality of terminal mounting portions;

a plurality of first electrical terminals mounted in said casing at said terminal-mounting portions, wherein said first electrical terminals are mounted in said casing before being carried into said first open end of the accommodation space;

a plurality of second electrical terminals inserted in said second open end and located in said accommodation space;

holding members on said body and said casing, said holding members cooperating so as to hold said casing in said accommodation space; and locking members on said casing acting to lock said first electrical terminals in position in said casing at least when said casing is inserted into and located in said accommodation space.

8. An electrical distribution box according to claim 7, wherein said locking members and said first electrical terminals are arranged to cooperate so that, when said first electrical terminals are incorrectly located in said casing in such a manner that said locking members do not lock said first electrical terminals in position, said locking members project from said casing into contact with the first open end so as to prevent insertion of said casing into said accommodation space.

9. An electrical distribution box according to claim 7, wherein said casing has a side wall and said locking members comprise resiliently flexible portions of said side wall having free ends including locking projections, said locking projections engaging said first electrical terminals to lock said first electrical terminals in said casing.

10. An electrical distribution box according to claim 7, wherein said body has a side wall and said casing has a side wall facing said side wall of said body, said holding members being constituted by respective projections on said side walls of said body and said casing.

11. An electrical distribution box according to claim 7, further comprising a partitioning member inserted into said body at the second open end of the accommodation space and acting to hold said second electrical terminals and said casing in position within the body.

12. An electrical distribution box according to claim 11, wherein said partitioning member prevents the locking members on the casing from opening when the casing is inserted into the accommodation space of the body.

* * * * *